US007120372B2

(12) United States Patent
Kim et al.

(10) Patent No.: US 7,120,372 B2
(45) Date of Patent: Oct. 10, 2006

(54) IMAGE-FORMING APPARATUS AND POWER-SAVING MODE CONTROL METHOD THEREOF

(75) Inventors: Jung-kuk Kim, Seoul (KR); Seok-heon Chae, Suwon-si (KR)

(73) Assignee: Samsung Electronics Co. Ltd., Suwon-Si (KR)

( * ) Notice: Subject to any disclaimer, the term of this patent is extended or adjusted under 35 U.S.C. 154(b) by 195 days.

(21) Appl. No.: 10/870,147

(22) Filed: Jun. 18, 2004

(65) Prior Publication Data

US 2005/0158067 A1 Jul. 21, 2005

(30) Foreign Application Priority Data

Jan. 15, 2004 (KR) ..... 10-2004-0003046

(51) Int. Cl.
*G03G 15/20* (2006.01)

(52) U.S. Cl. ..... 399/70; 399/43; 399/82

(58) Field of Classification Search ..... 399/70, 399/69, 67, 320, 43, 82; 347/156
See application file for complete search history.

(56) References Cited

U.S. PATENT DOCUMENTS 4,745,436 A * 5/1988 Matsuura ..... 399/70
5,881,335 A * 3/1999 Yang ..... 399/70
6,321,046 B1 * 11/2001 Kikuchi et al. ..... 399/69
6,390,585 B1 5/2002 Schiaffino et al. ..... 347/17
6,674,980 B1 * 1/2004 Nakaya ..... 399/69
6,801,730 B1 * 10/2004 Johnson et al. ..... 399/75

FOREIGN PATENT DOCUMENTS

| | | |
|---|---|---|
| JP | 09-076602 | 3/1997 |
| JP | 2000-001022 | 1/2000 |
| KR | 97-22597 | 5/1997 |

* cited by examiner

*Primary Examiner*—Sophia S. Chen
(74) *Attorney, Agent, or Firm*—Roylance, Abrams, Berdo & Goodman, LLP

(57) ABSTRACT

An image-forming apparatus and a power-saving mode control method thereof are disclosed. The power-saving mode control method for the image-forming apparatus includes calculating a lapsed time after the image-forming apparatus enters a power-saving mode, that is, a power-saving mode duration time Ts, and determining a cause of the power-saving mode being turned off, selecting a different warm-up mode depending on the cause of the power-saving mode being turned off and the power-saving mode duration time; and controlling warm-up operations to be performed according to the selected warm-up mode.

12 Claims, 3 Drawing Sheets

IMAGE-FORMING APPARATUS AND POWER-SAVING MODE CONTROL METHOD THEREOF

CROSS-REFERENCE TO RELATED APPLICATIONS

This application claims benefit under 35 U.S.C. § 119(a) from Korean Patent Application No. 2004-3046, filed on Jan. 15, 2004, the entire contents of which are incorporated herein by reference.

BACKGROUND OF THE INVENTION

1. Field of the Invention

The present invention relates generally to an image-forming apparatus and a power-saving mode control method thereof. More particularly, the present invention pertains to an image-forming apparatus and a power-saving control method for reducing a printing time by reducing a warm-up time when a power-saving mode powers off as well as preventing motors from being unnecessarily driven and a fuser from being heated.

2. Description of the Related Art

Image-forming devices print images onto a recording medium such as paper corresponding to original image data that was input. Examples of image-forming devices include printers, photocopiers, and facsimile machines. In general, image-forming apparatus have a power-saving mode to reduce power consumption when the image-forming apparatus is not used.

A description will now be made on the operation of an image-forming apparatus having a conventional power-saving mode function.

FIG. 1 is a flowchart illustrating the operation of an image-forming apparatus having a conventional power-saving mode function. Referring to FIG. 1, if a user requests a power-saving mode or if a standby state lasts for a certain time, the image-forming apparatus goes into the power-saving mode at step S11.

In the power-saving mode, the image-forming apparatus determines whether a request is made to turn off the power-saving mode at step S12.

The power-saving mode is turned off when a print command is received from a host or when sensors related to the turn-off of the power-saving mode operate. The sensors related to the turn-off of the power-saving mode include a sensor for detecting whether the printer cover is opened, a sensor for detecting whether cassettes exist, a sensor for detecting whether paper exists in the cassette, and a sensor for detecting manually loaded paper.

If there is the request to enter the power-saving mode, the image-forming apparatus enters the power-saving mode. If the image-forming apparatus goes from the power-saving mode, the image-forming apparatus performs certain warm-up operations for a period, and enters a standby mode at step S13. If the power-saving mode is turned off due to the print command, the apparatus goes into the print mode when entering the standby mode.

Image-forming devices having the above conventional power-saving mode function perform the warm-up operation when receiving a print command after entering the power-saving mode, or when turning off the power-saving mode due to operation of the cover detection sensor, the paper detection sensor, or the like. Thus, the devices takes a certain time period to warm up when the power-saving mode is turned off. However, the warm up time may be unnecessary depending on the circumstances.

For example, the apparatus may start printing after the warm-up operation even when receiving a print command just as it was entering the power-saving mode. This results in a delay in printing based on the unnecessary warm-up period.

Furthermore, a heated fusion roller results in unnecessary power consumption during warm-up. The driving of motors during the warm-up activates the photosensitive drum together with most of other rollers such as a transfer roller, a developing roller, and a charging roller so that the life span of the rollers may be shortened.

SUMMARY OF THE INVENTION

The present invention has been developed in order to solve the above drawbacks and other problems associated with the conventional arrangement and to provide additional benefits. An aspect of the present invention is to provide an image-forming apparatus and a power-saving mode control method thereof capable of reducing unnecessary power consumption and enhancing printing speed by shortening a warm-up time during which warm-up operations are performed after a power-saving mode has been turned off.

Another aspect of the present invention is to provide an image-forming apparatus and a power-saving mode control method thereof, capable of preventing the life span of rollers from being shortened as well as reducing power consumption during a prolonged warm-up operation time.

The forgoing and other aspects and advantages are substantially realized by providing a power-saving mode control method for image-forming apparatuses, which includes calculating a lapsed time after the image-forming apparatus enters a power-saving mode, that is, a power-saving mode duration time Ts, and determining the cause for the power-saving mode being turned off, setting a different warm-up mode depending on the cause of the power-saving mode being turned off and the power-saving mode duration time, and controlling warm-up operations to be performed according to the set warm-up mode.

The power-saving mode is preferably turned off based on any of a print command, activation of a paper detection sensor, and activation of a cover-opening detection sensor.

It is preferable that the warm-up mode is a first warm-up mode to be set when the power-saving mode is turned off due to a print command or activation of a paper detection sensor or a second warm-up mode to be set when the power-saving mode is turned off due to activation of the cover-opening detection sensor.

The first warm-up mode preferably controls only a fuser to be heated during the warm-up operations if the power-saving mode duration time Ts is less than a predetermined first time T1.

If a predetermined second time T2 is more than the first time T1 and the power-saving mode duration time Ts is between the first time T1 and the second time T2, the first warm-up mode preferably controls the fuser to be heated and a motor for the fuser to be driven during the warm-up operations.

The second warm-up mode preferably performs the warm-up operations for a minimum period of time necessary for driving a motor for a developing part if the power-saving mode duration time Ts is less than a predetermined third time T3.

An image-forming apparatus having a power-saving mode function includes a counter for calculating a lapsed time after the image-forming apparatus enters a power-saving mode, that is, a power-saving mode duration time Ts, and a controller for determining a cause for the power-saving mode being turned off, setting a different warm-up mode depending on the cause for the power-saving mode being turned off and the power-saving mode duration time, and controlling warm-up operations to be performed according to the set warm-up mode.

It is preferable that the power-saving mode is turned off based on any of a print command, activation of a paper detection sensor, and activation of a cover-opening detection sensor.

It is preferable that the warm-up mode is a first warm-up mode to be set when the power-saving mode is turned off due to a print command or activation of a paper detection sensor or a second warm-up mode to be set when the power-saving mode is turned off due to activation of the cover-opening detection sensor.

The first warm-up mode preferably controls only a fuser to be heated during the warm-up operations if the power-saving mode duration time Ts is less than a predetermined first time T1.

If a predetermined second time T2 is more than the first time T1 and the power-saving mode duration time Ts is between the first time T1 and the second time T2, the first warm-up mode preferably controls the fuser to be heated and a motor for the fuser to be driven during the warm-up operations.

The second warm-up mode preferably performs the warm-up operations for a minimum period of time necessary for driving a motor for a developing part if the power-saving mode duration time Ts is less than a predetermined third time T3.

BRIEF DESCRIPTION OF THE DRAWINGS

The above aspects and features of the present invention will be more apparent by describing certain embodiments of the present invention with reference to the accompanying drawings, in which.

In the drawings, it should be noted that the same or similar elements are denoted by the same reference numerals even though they are depicted in different drawings.

DETAILED DESCRIPTION OF THE EXEMPLARY EMBODIMENTS

Hereinafter, descriptions will be made in detail of an image-forming apparatus and a power-saving mode control method according to embodiments of the present invention.

Figure 1:
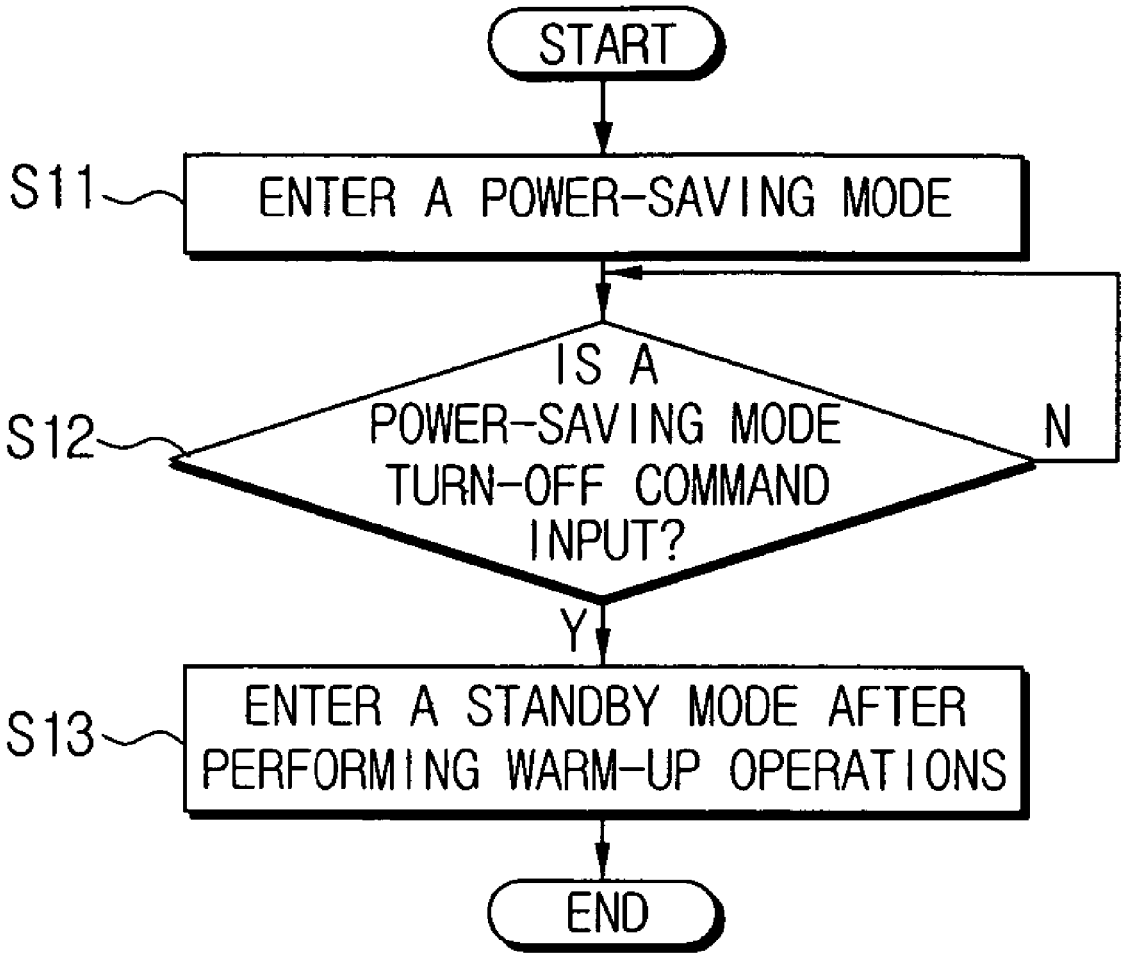
FIG. 1 (PRIOR ART)
FIG. 1 is a flowchart illustrating operations of an image-forming apparatus having a conventional power-saving mode function.
Figure 2:
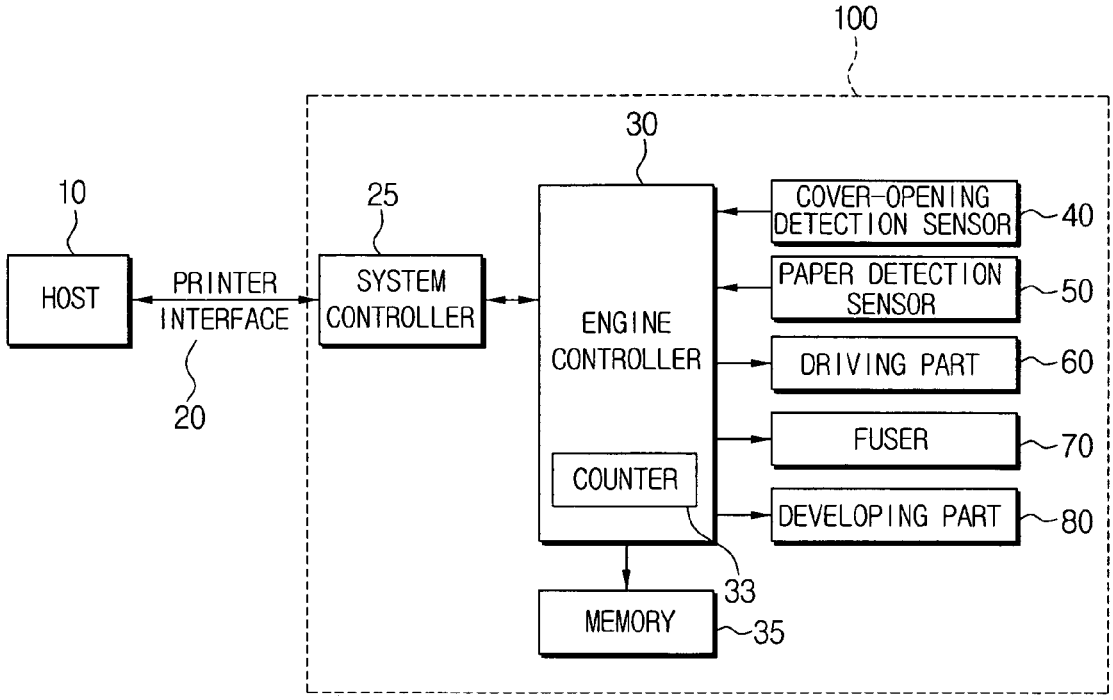
FIG. 2 is a block diagram illustrating an inner structure of an image-forming apparatus according to an embodiment of the present invention.

FIG. 2 is a block diagram illustrating an inner structure of an image-forming apparatus according to an embodiment of the present invention.

Referring to FIG. 2, the image-forming apparatus according to an embodiment of the present invention includes a system controller 25, a controller 30, a counter 33, a memory 35, a cover-opening detection sensor 40, a paper detection sensor 50, a driving part 60, a fuser 70, and a developing part 80.

The cover-opening detection sensor 40 detects whether the cover of the image-forming apparatus is opened. The paper detection sensor 50 includes all sensors, such as a cassette load or unload sensor, a cassette paper detection sensor, a manual paper load or unload sensor, an option cassette load or unload sensor, and an optional cassette paper detection sensor, that can detect whether a user loads paper.

The driving part 60 activates motors to drive individual rollers coupled with gears. The developing part 80 comprises a photosensitive drum, a charging roller, a developing roller, and a transfer roller, and forms images on paper. The fuser 70 comprises a heat roller and a pressure roller, and fuses toner onto paper.

The system controller 25 receives a print command through a printer interface 20 from a host 10, and sends the command to the controller 30.

In the power-saving mode, the controller 30 controls the counter 33 to increment, and the counter 33 keeps incrementing till the power-saving mode is turned off. The time counted in the counter 33 from the time at which the power-saving mode is set to the time at which the power-saving mode is turned off, is referred to as a power-saving mode duration time Ts. The power-saving mode duration time counted in the counter 33 is stored in the memory 35.

According to an embodiment of the present invention, the counter 33 is located in the controller 30, but does not need to be in the controller 30. Any counter can be used for the counter 33, and the counter 33 is preferably implemented in a physical or software manner.

If a print command is input when the apparatus is in the power-saving mode, the controller 30 performs warm-up operations, by controlling the driving part 60, developing part 80, and fuser 70 in a different warm-up mode according to the power-saving mode duration time counted in the counter 33.

The controller 30 periodically detects outputs of certain sensors. If the outputs of certain sensors are changed, the controller 30 performs the warm-up operations, by controlling the driving part 60, developing part 80, and fuser 70 in a different warm-up mode based on the power-saving mode duration time.

Figure 3:
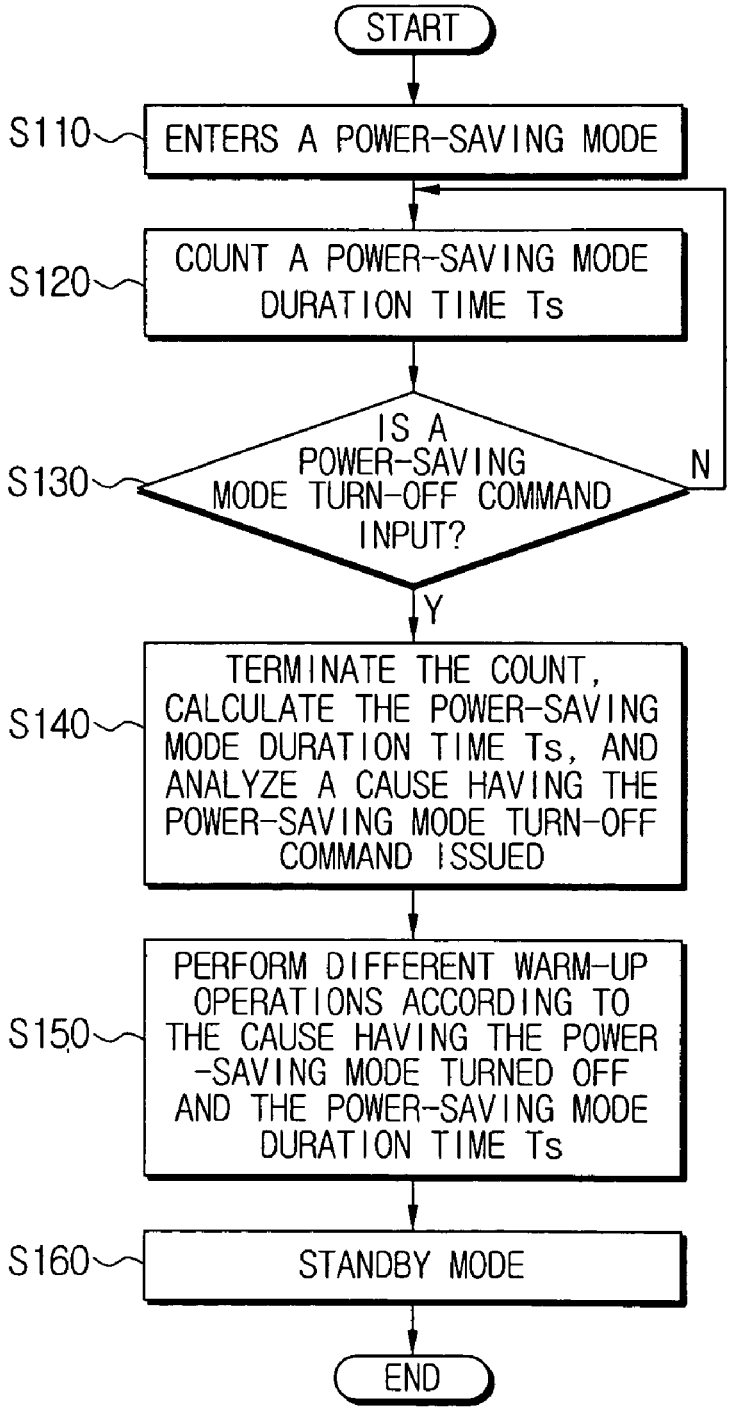
FIG. 3 is a flowchart illustrating operations of the image-forming apparatus according to an embodiment of the present invention.

FIG. 3 is a flowchart illustrating a power-saving mode control method according to an embodiment of the present invention.

Referring now to FIGS. 2 and 3, if the host 10 requests the power-saving mode, the image-forming apparatus 100 enters the power-saving mode at step S110.

The counter 33 counts the period of time from the time at which the apparatus 100 enters the power-saving mode to the time at which the apparatus 100 exits the power-saving mode, that is, the power-saving mode duration time Ts, and stores the value of the power-saving duration time in the memory 35 at step S120.

The controller 30 determines whether a power-saving mode turn-off command is sent through the system controller 25 at step S130.

If the power-saving mode turn-off command is received, the controller 30 controls the counter not to operate, and determines the cause why the power-saving mode turn-off command occurred at step S140.

Two situations usually cause the power-saving mode turn-off command to occur.

First, the power-saving mode turn-off command occurs when a print command is issued from the host or when the paper detection sensor 50 detects the presence of paper, for example, a user trying to manually feed paper to the image forming apparatus. Since this occurrence does not affect the developing part 80, the photosensitive drum is not cleaned. Accordingly, the warm-up operations are mainly performed on behalf of the controls of the fuser 70.

Second, the power-saving mode turn-off command occurs when the cover-opening detection sensor 40 detects the opening of the cover of the image forming apparatus. In the circumstances, the cover of the image-forming apparatus is opened and then paper jams have to be cleared, but some changes to the inside of the image-forming apparatus 100 can be made, such as the replacement of the developing part. Thus, the warm-up operations are performed, and cleaning of the photosensitive drum is also performed.

If any of the two occasions is determined as the cause of the power-saving mode turn-off command, the controller 30 has a different warm-up mode set based on the cause of the turning off the power-saving mode and the power-saving mode duration time Ts, and performs the warm-up operations according to the set warm-up mode at step S150.

The warm-up modes are different from each other based on the situation for turning off the power-saving mode. The first warm-up mode is enabled when the power-saving mode is turned off due to a print command from the host 10 or due to the activation of the paper detection sensor 50. The second warm-up mode is enabled when the power-saving mode is turned off due to the activation of the cover-opening detection sensor 40.

Table 1 shows the first warm-up mode when the power-saving mode is turned off due to a print command issued from the host 10 or due to the activation of the paper detection sensor 50.

TABLE 1

| | Print command or paper detection sensor | | |
|---|---|---|---|
| Control method | Ts < T1 | T1 ≦ Ts < T2 | T2 < Ts |
| To control fuser | 0 | 0 | 0 |
| To drive the motor for the fuser | X | 0 | 0 |
| To drive the motor for the developing part | X | X | 0 |
| Total warm-up time | Ta | Tb | Tt |

T1 and T2 denote predetermined times, respectively, and have different values according to the appearance or print system of the image-forming apparatus itself.

If the power-saving mode duration time Ts is less than a predetermined time T1, that is, Ts<T1, the controller 30 warms-up the fuser 70 heated. The predetermined time T1 is less than one minute, preferably, about tens of seconds.

Thus, the time needed for the warm-up operations corresponds to a time Ta for the fuser 70 to be heated, and the time Ta is reduced compared with the related art. In the circumstances, the life of the respective rollers is extended since the warm-up operations do not require the motor for the fuser 70 and the motor for the developing part 80 to be driven.

If the power-saving mode duration time Ts is equal to or more than the time T1 and less than the time T2, that is, T1≦Ts<T2, the controller 30 controls the motor for the fuser 70 to be driven, in addition to controlling the fuser 70 to be heated.

If the motor for the fuser 70 is separated from the motor for the developing part 80, the controller 30 controls only the motor for the fuser 70 to be driven. If the motor for the fuser 70 is incorporated with the motor for the developing part 80, the controller 30 controls the motor for the developing part 80 to be driven together with the motor for the fuser 70, and controls the total warm-up time to be determined depending on the time necessary for securing the fusion of toner. The time T2 is less than ten minutes, preferably, a few minutes.

If the power-saving mode duration time Ts is more than the time T2, the controller 30 controls the warm-up operations to be performed as in the prior art. That is, the controller 30 controls the fuser 70 to be heated, and controls the motor for the fuser 70 to be driven. Furthermore, the controller controls the motor for the developing part 80 to be driven so that the photosensitive drum is cleaned.

Table 2 shows the second warm-up mode when the image-forming apparatus exits the power-saving mode due to the activation of the cover-opening sensor 40.

TABLE 2

| | Cover-opening detection sensor | |
|---|---|---|
| Control method | Ts < T3 | T3 ≦ Ts |
| To control the fuser | O | O |
| To drive the motor for the fuser | O | O |
| To drive the motor for the developing part | O | O |
| Total warm-up time | Tc | Tt |

The photosensitive drum is cleaned every time the power-saving mode is turned off due to the activation of the cover-opening detection sensor 40, and the minimum time Tc for the photosensitive drum to be cleaned. If the power-saving mode duration time Ts is less than a certain time T3, the controller 30 performs the warm-up operations for the minimum time Tc necessary for the photosensitive drum to be cleaned.

If the power-saving mode duration time Ts is equal to or more than the predetermined time T3, the controller 30 performs the warm-up operations as in the prior art.

As aforementioned, the image-forming apparatus performs different warm-up operations depending on the warm-up mode and power-saving mode duration time, and then enters the standby mode at step S160. The subsequent operations are the same as in the conventional image-forming apparatus.

As stated above, the present invention determines the power-saving mode duration time Ts, and performs different warm-up operations depending on the power-saving mode duration time. As a result, power consumption is reduced by preventing power from being unnecessarily consumed due to heating the fusion roller for more than a necessary period of time.

The embodiments of the present invention require no or little warm-up time in some circumstances, thus improving the printing speed.

The foregoing embodiments and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A power-saving mode control method for an image-forming apparatus, comprising:

calculating a lapsed time Ts after the image-forming apparatus enters a power-saving mode and determining a cause of the power-saving mode being turned off;

selecting a different warm-up mode depending on the cause of the power-saving mode being turned off and the power-saving mode duration time; and controlling warm-up operations to be performed according to the selected warm-up mode.

2. The power-saving mode control method as claimed in claim 1, wherein the power-saving mode is turned off due to any one of a print command, activation of a paper detection sensor, and activation of a cover-opening detection sensor.

3. The power-saving mode control method as claimed in claim 1, wherein the warm-up mode is a first warm-up mode to be selected when the power-saving mode is turned off due to a print command or activation of a paper detection sensor or a second warm-up mode to be selected when the power-saving mode is turned off due to activation of a cover-opening detection sensor.

4. The power-saving mode control method as claimed in claim 3, wherein the first warm-up mode controls a fuser to be heated during the warm-up operations if the power-saving mode duration time Ts is less than a predetermined first time T1.

5. The power-saving mode control method as claimed in claim 4, wherein, if a predetermined second time T2 is equal to or more than the first time T1 and the power-saving mode duration time Ts is between the first time T1 and the second time T2, the first warm-up mode controls the fuser to be heated and a motor for the fuser to be driven during the warm-up operations.

6. The power-saving mode control method as claimed in claim 3, wherein the second warm-up mode performs the warm-up operations for a minimum period of time necessary for driving a motor for a developing part if the power-saving mode duration time Ts is less than a predetermined third time T3.

7. An image-forming apparatus having a power-saving mode function, comprising:

a counter for calculating a lapsed time after the image-forming apparatus enters a power-saving mode, that is, a power-saving mode duration time Ts; and a controller for determining a cause of the power-saving mode being turned off, selecting a different warm-up mode depending on the cause of the power-saving mode being turned off and the power-saving mode duration time, and controlling warm-up operations to be performed according to the selected warm-up mode.

8. The image-forming apparatus as claimed in claim 7, wherein the power-saving mode is turned off due to any one of a print command, activation of a paper detection sensor, and activation of a cover-opening detection sensor.

9. The image-forming apparatus as claimed in claim 7, wherein the warm-up mode is a first warm-up mode to be selected when the power-saving mode is turned off due to a print command or activation of a paper detection sensor or a second warm-up mode to be selected when the power-saving mode is turned off due to activation of a cover-opening detection sensor.

10. The image-forming apparatus as claimed in claim 9, wherein the first warm-up mode controls a fuser to be heated during the warm-up operations if the power-saving mode duration time Ts is less than a predetermined first time T1.

11. The image-forming apparatus as claimed in claim 10, wherein, if a predetermined second time T2 is more than the first time T1 and the power-saving mode duration time Ts is between the first time T1 and the second time T2, the first warm-up mode controls the fuser to be heated and a motor for the fuser to be driven during the warm-up operations.

12. The image-forming apparatus as claimed in claim 9, wherein the second warm-up mode performs the warm-up operations for a minimum period of time necessary for driving a motor for a developing part if the power-saving mode duration time Ts is less than a predetermined third time T3.

* * * * *